US007738321B2

(12) United States Patent
Ogasawara

(10) Patent No.: US 7,738,321 B2
(45) Date of Patent: Jun. 15, 2010

(54) RADIO-CONTROLLED TIMEPIECE

(75) Inventor: Kenji Ogasawara, Chiba (JP)

(73) Assignee: Seiko Instruments Inc. (JP)

( * ) Notice: Subject to any disclaimer, the term of this patent is extended or adjusted under 35 U.S.C. 154(b) by 335 days.

(21) Appl. No.: 11/985,521

(22) Filed: Nov. 15, 2007

(65) Prior Publication Data

US 2008/0117720 A1 May 22, 2008

(30) Foreign Application Priority Data

Nov. 22, 2006 (JP) ..... 2006-315519

(51) Int. Cl.
*G04C 11/02* (2006.01)

(52) U.S. Cl. ..... 368/47

(58) Field of Classification Search ..... 368/10, 368/46–47, 59, 185, 187, 190
See application file for complete search history.

(56) References Cited

U.S. PATENT DOCUMENTS 5,036,500 A 7/1991 Ganter ..... 368/46
5,077,706 A * 12/1991 Ganter ..... 368/47
5,177,714 A * 1/1993 Ganter et al. ..... 368/47
5,408,445 A * 4/1995 Allgaier et al. ..... 368/47
6,967,901 B2 11/2005 Shimizu ..... 368/47
7,075,859 B2 * 7/2006 Miyahara et al. ..... 368/47
2004/0004909 A1 1/2004 Fujimori ..... 368/204

FOREIGN PATENT DOCUMENTS

EP 1349022 10/2003
EP 1465027 10/2004
JP 2002139586 5/2002
JP 2004003927 1/2004

* cited by examiner

*Primary Examiner*—Vit W Miska
(74) *Attorney, Agent, or Firm*—Adams & Wilks

(57) ABSTRACT

To make a setting as to whether or not a time code is automatically received simple, and suppress a wasteful use of an electric power by a reception operation under an environment incapable of suitably receiving the time code. A reception circuit receives and outputs the time code through an antenna, and a control circuit corrects a time instant which is being clocked to a time instant corresponding to the time code. If a crown is operated to a time instant correction position, an input circuit outputs an operation signal denoting this. The control circuit responds to the operation signal to thereby control a reception operation of the reception circuit to OFF. At this time, a time instant correction is performed by hand by operating the crown.

9 Claims, 7 Drawing Sheets

RADIO-CONTROLLED TIMEPIECE

BACKGROUND OF THE INVENTION

1. Field of the Invention

The present invention relates to a radio-controlled timepiece correcting a time instant on the basis of a time code received by a radio.

2. Description of the Related Art

From olden times, there is utilized the radio-controlled timepiece receiving a standard radio signal including the time code denoting a present time instant by the radio, thereby correcting the time instant in an inside of the radio-controlled timepiece. Even in a case where an error occurs in the radio-controlled timepiece, by correcting the time instant on the basis of the received time code, there can be corrected to an accurate time instant and displayed.

By the way, since the radio-controlled timepiece possesses a reception means for receiving the standard radio signal and the reception means consumes a large electric power, there is developed a radio-controlled timepiece in which there is contrived to save the electric power by reducing an electric power consumption of the reception means.

For example, in Patent Document JP-A-2002-139586 Gazette (Paragraphs [0014]-[0017], FIG. 1), there is disclosed a radio-controlled timepiece in which an automatic reception frequency at an electricity-saving time is decreased by diminishing an automatic reception frequency of the time code in compliance with an electricity generation state, thereby altering a reception operation in compliance with a situation of an electric source.

Further, in Patent Document JP-A-2004-3927 Gazette (Paragraphs [0034]-[0057], FIG. 1-FIG. 4), there is disclosed a radio-controlled timepiece in which there is made such that the automatic reception frequency of the time code is diminished in compliance with a reception situation.

In each of inventions described in the Patent Documents, although it is possible to contrive to save the electric power, since a setting of a timing automatically receiving the time code is intricate and the reception operation is repeated by a predetermined frequency also under an environment in which the standard radio signal can not be received normally, there is an issue that the large electric power is wastefully consumed.

Problems of the present invention are that a setting as to whether or not the time code is automatically received is simple, and a wasteful use of the electric power by the reception operation under an environment incapable of suitably receiving the time code is suppressed.

SUMMARY OF THE INVENTION

According to the present invention, there is provided a radio-controlled timepiece characterized by possessing a reception means receiving and outputting a time code denoting a present time instant by a radio, a clock means clocking a time instant, a display means displaying a clocked time instant of the clock means, a time instant correction means correcting the time instant that the clock means is clocking to a time instant corresponding to the time code received by the reception means, an operation means in which a time instant correction operation is possible in a predetermined time instant correction position, and a control means controlling a reception operation of the reception means to OFF when the operation means is placed in the time instant correction position.

The reception means receives and outputs the time code denoting the present time instant by the radio. The time instant correction means corrects the time instant that the clock means is clocking to the time instant corresponding to the time code received by the reception means. The control means controls the reception operation of the reception means to OFF when the operation means is operated to the time instant correction position.

Here, there may be constituted such that the control means controls the reception operation of the reception means to ON when the operation means is predetermination-operated and placed in a position other than the time instant correction position.

Further, there may be constituted such that it has a reception operation ON operation means for making ON the reception operation of the reception means, and the control means controls the reception operation of the reception means to ON when the reception operation ON operation means is operated.

Further, there may be constituted such that the operation means has a crown, and the control means controls the reception operation of the reception means to OFF when the crown is placed in the time instant correction position.

Further, there may be constituted such that the control means controls the reception operation of the reception means to ON when the crown is predetermination-operated and placed in the position other than the time instant correction position.

According to the present invention, the setting as to whether or not the time code is automatically received is simple, and it becomes possible to suppress the wasteful use of the electric power by the reception operation under the environment incapable of suitably receiving the time code.

Further, it becomes possible to perform an ON/OFF switching of the reception operation in compliance with a reception environment of the time code.

Further, by performing an operation along a flow of an ordinary use of the radio-controlled timepiece, it is possible to easily perform the ON/OFF switching of the reception operation without being conscious of the ON/OFF switching of the reception operation, so that it becomes possible to perform an operation having no sense of discomfort.

DESCRIPTION OF THE PREFERRED EMBODIMENTS

Figure 1:
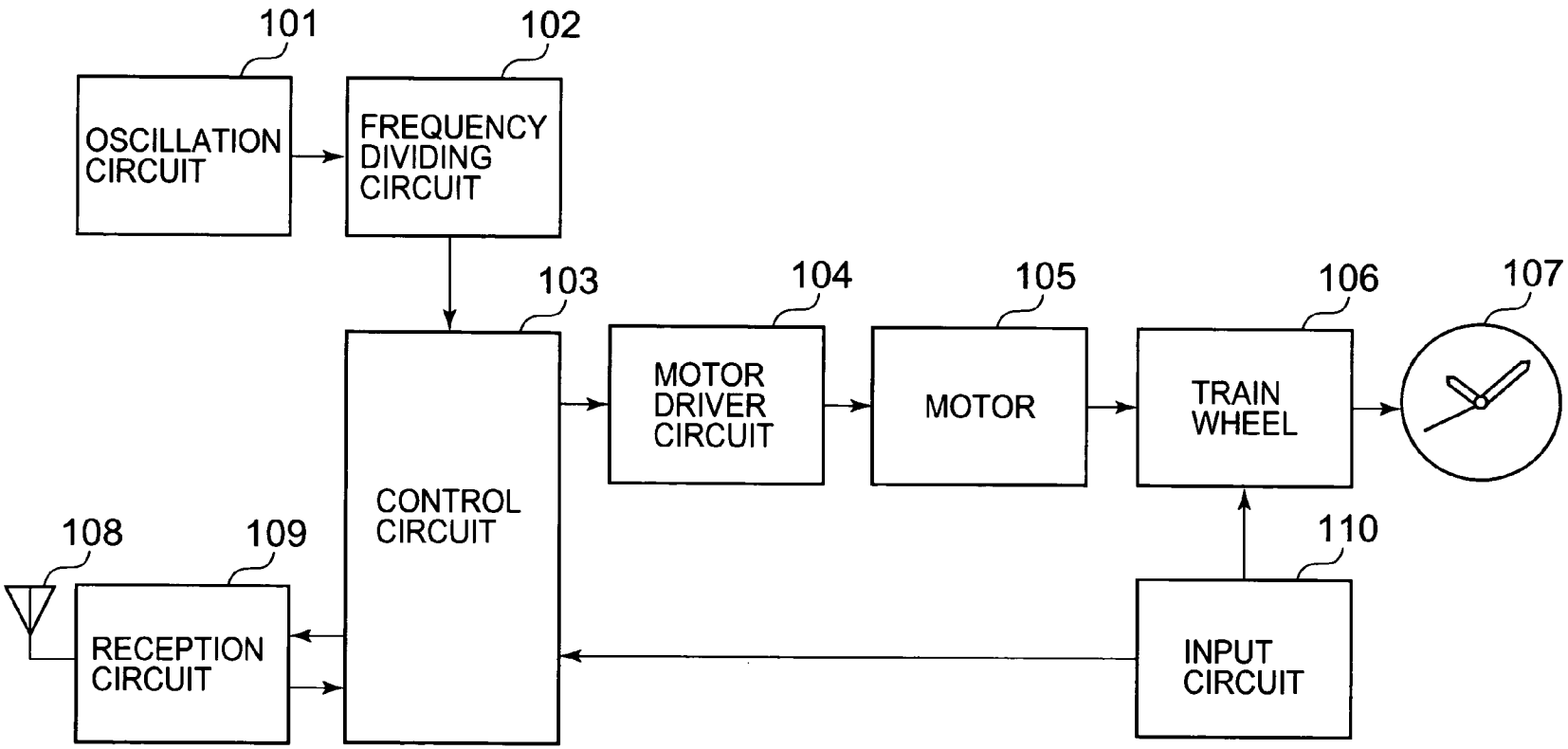
FIG. 1 is a block diagram of a radio-controlled timepiece common to first to third embodiments of the present invention.

FIG. 1 is a block diagram of a radio-controlled timepiece concerned with an embodiment of the present invention, and a block diagram common to first-third embodiments.

In FIG. 1, the radio-controlled timepiece possesses an oscillation circuit 101 outputting a signal of a predetermined frequency, a frequency dividing circuit 102 frequency-dividing the signal from the oscillation circuit 101 to thereby output a time signal becoming a reference of a clock operation, a control circuit 103 performing, by performing the clock operation based on the time signal, an output processing of a control signal for a time instant display, a control processing of each constituent element of the radio-controlled timepiece, or an after-mentioned processing and the like, a motor driver circuit 104 responding to the control signal from the control circuit 103 to thereby output a motor drive signal, a motor 105 rotation-driven by the motor drive signal, a train wheel 106 transmitting a rotation of the motor 105, a display part 107 having time instant hands (an hour hand, a minute hand, and the like) rotation-driven by the train wheel 106, an antenna 108 receiving the standard radio signal including the time code by the radio, a reception circuit 109 outputting the time code included in the standard radio signal received by the antenna 108, and an input circuit 110 inputting an operation signal complying with an operation of a crown (not shown in the drawing).

Here, the control circuit 103 is clocking a present time instant by counting the time signal, and constitutes a clock means. Further, the control circuit 103 constitutes a time instant correction means correcting the present time instant which is being clocked to a time instant corresponding to the received time code, and a control means responding to a predetermined operation signal from the input circuit 110 to thereby control a reception operation of the reception circuit 109 to OFF. The antenna 108 and the reception circuit 109 constitute a reception means receiving the time code by the radio. Further, the display part 107 constitutes a display means, and the input circuit 110 constitutes, together with a crown mentioned later, an operation means.

Figure 2:
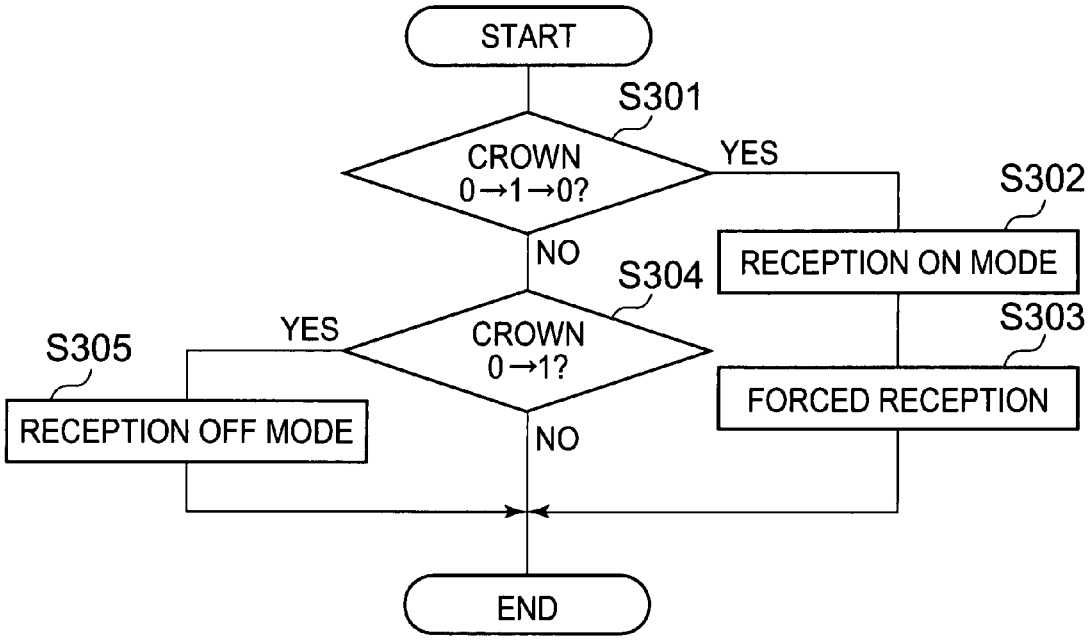
FIG. 2 is a flowchart showing processing of the first embodiment of the present invention.

FIG. 2 is a flowchart showing processing of the first embodiment of the present invention, and shows mainly the processing of the control circuit 103.

Figure 3:
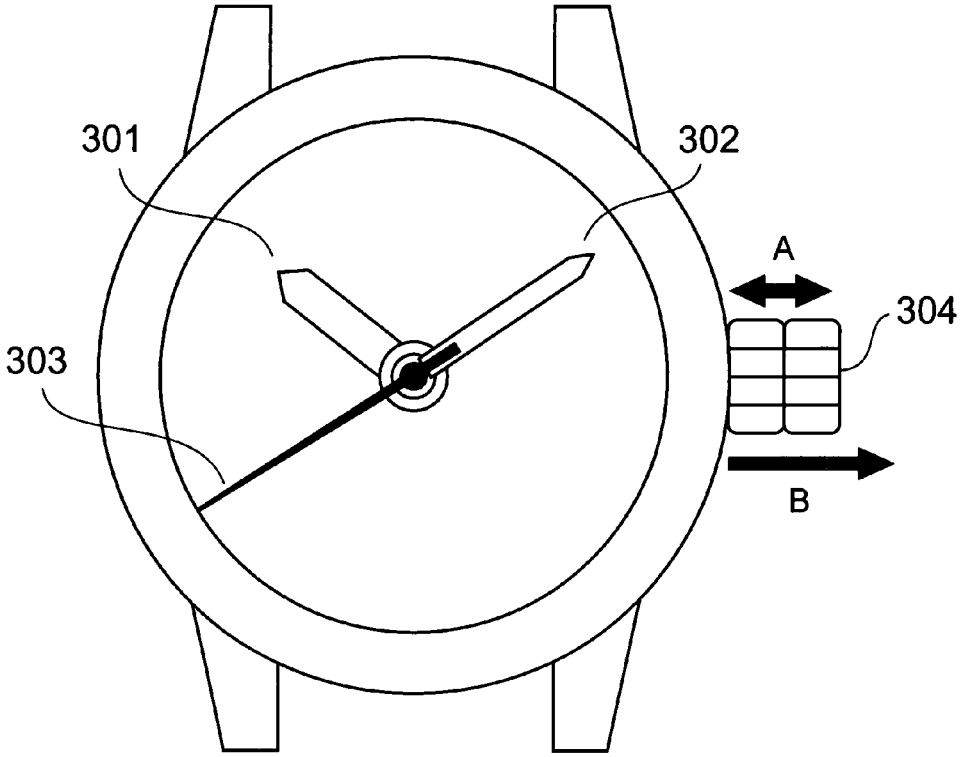
FIG. 3 is an external appearance view for explaining an operation of the first embodiment of the present invention.

Further, FIG. 3 is an external appearance view for explaining an operation of the first embodiment of the present invention. The radio-controlled timepiece possesses time instant hands comprising an hour hand 301, a minute hand 302 and a second hand 303, and a crown 304. The crown 304 is constituted so as to be capable of being pull-operated by one stage in an arrow B direction. The input circuit 110 in FIG. 2 detects a state of the crown 304, and outputs an operation signal complying with that state. The crown 304 constitutes, together with the input circuit 110, the operation means.

Hereunder, by using FIG. 1-FIG. 3, there is explained the operation of the first embodiment of the present invention.

In an ordinary mode in which there is performed the clock operation based on a timepiece signal from the frequency dividing circuit 102, the radio-controlled timepiece performs the clock operation by the fact that the control circuit 103 counts the timepiece signal from the frequency dividing circuit 102, thereby outputting a control signal corresponding to the clocked time instant to the motor driver circuit 104. The motor driver circuit 104 rotation-drives the motor 105 by a drive signal corresponding to the control signal. The motor 105 rotation-drives the time instant hands of the display part 107 through the train wheel 106, thereby performing an analog display of the present time instant in the display part 107.

In a time instant correction mode in which a time instant correction is performed by receiving the time code included in the standard radio signal, the control circuit 103 causes the reception circuit 109 to perform a reception operation of the standard radio signal by making ON an electric source of the reception circuit 109. The reception circuit 109 outputs the time code included in the standard radio signal received by the antenna 108 to the control circuit 103.

The control circuit 103 corrects own clocked time instant to an accurate present time instant corresponding to the time code, and outputs a control signal corresponding to the accurate present time instant to the motor driver circuit 104. The motor driver circuit 104 rotation-drives the motor 105 by a drive signal corresponding to the control signal, and the motor 105 rotation-drives the time instant hands of the display part 107 through the train wheel 106, thereby performing the analog display of the accurate present time instant corresponding to the time code in the display part 107.

Next, there is explained about a switching operation as to whether or not the standard radio signal is received.

The input circuit 110 outputs an operation signal complying with a state of the crown 304. On the basis of the operation signal from the input circuit 110, the control circuit 103 judges, after the crown 304 was made one-stage-pull-operated position (a state "1") from an accommodation position (a state "0") as shown by an arrow A in FIG. 3, whether or not there was performed again a return operation (a reception ON mode operation) to the accommodation position (the state "0") (a step S301).

In a case where there was judged in the processing step S301 that the reception ON mode operation was performed on the basis of the operation signal, the control circuit 103 sets to a reception ON mode in which a periodic automatic reception is made ON (a step S302) and, by supplying an electric source to the reception circuit 109, forcibly performs a reception of the standard radio signal by making ON a reception operation of the reception circuit 109, thereby performing the time instant correction (a step S303).

In a case where it was judged in the processing step S301 that the reception ON mode operation was not performed, the control circuit 103 judges whether or not there was performed one stage pull operation (a reception OFF mode operation) in which the crown 304 remains in its one-stage-pulled position (the state "1") from the accommodation position (the state "0") as shown by the arrow B in FIG. 3 (a step S304). That is, the control circuit 103 judges whether or not the crown 304 was operated so as to be placed in the one-stage-pulled position in which a time instant correction is possible by a manual operation.

In a case where it was judged in the processing step S304 that the reception OFF mode operation was performed on the basis of the operation signal, the control circuit 103 sets to a reception OFF mode making OFF the following automatic reception operation (a step S305). Under this state, by rotation-operating the crown 304, it is possible to perform the time instant correction by the manual operation.

In a case where it was judged in the processing step S304 that the reception OFF mode operation was not performed on the basis of the operation signal, the control circuit 103 finishes the processing.

Like the above, according to the present first embodiment, there is made such that, when the crown 304 was made a time instant correction position by hand, the automatic reception operation is made OFF. Under this state, by rotation-operating the crown 304, it is possible to perform the time instant correction by the manual operation.

By doing like this, since it becomes possible that a user makes OFF the reception operation in a flow ordinarily using the timepiece without being conscious of making OFF the reception operation, the setting as to whether or not the time code is automatically received is simple, and it becomes possible to suppress the wasteful use of the electric power by the reception operation under the environment incapable of suitably receiving the time code.

Further, in compliance with whether or not there exists under an environment capable of receiving the time code, it becomes possible that the user easily performs the ON/OFF switching of the reception operation.

Further, by performing the operation along the flow of the ordinary use of the radio-controlled timepiece, it is possible to perform the ON/OFF switching of the reception operation without being conscious of the ON/OFF switching of the reception operation, so that it becomes possible to perform the operation having no sense of discomfort.

Figure 4:
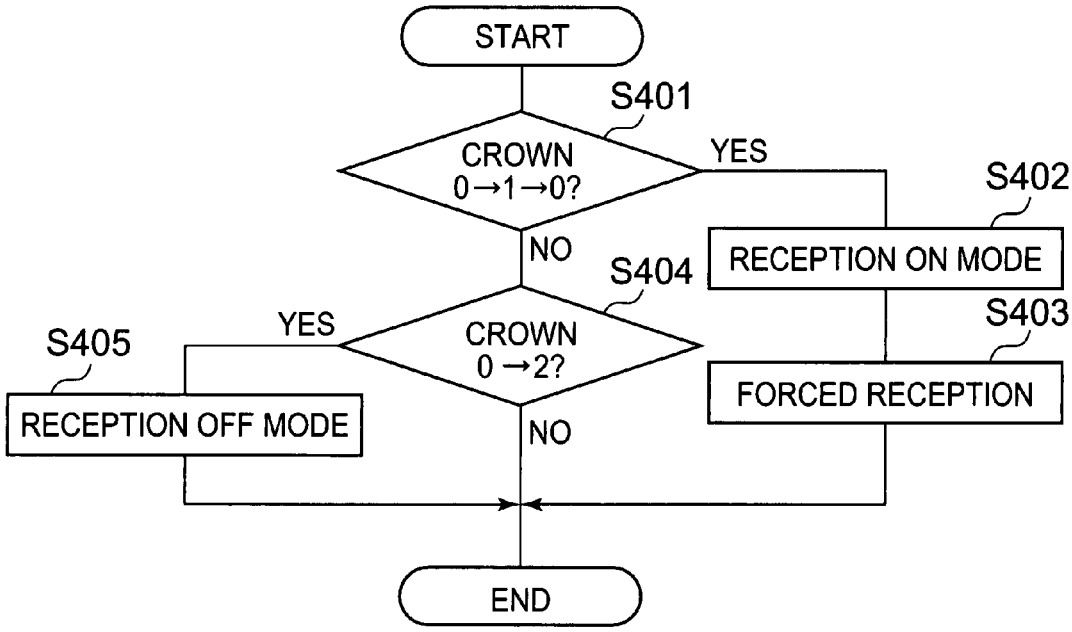
FIG. 4 is a flowchart showing processing of a second embodiment of the present invention.

FIG. 4 is a flowchart showing processing of the second embodiment of the present invention, and shows mainly the processing of the control circuit 103.

Figure 5:
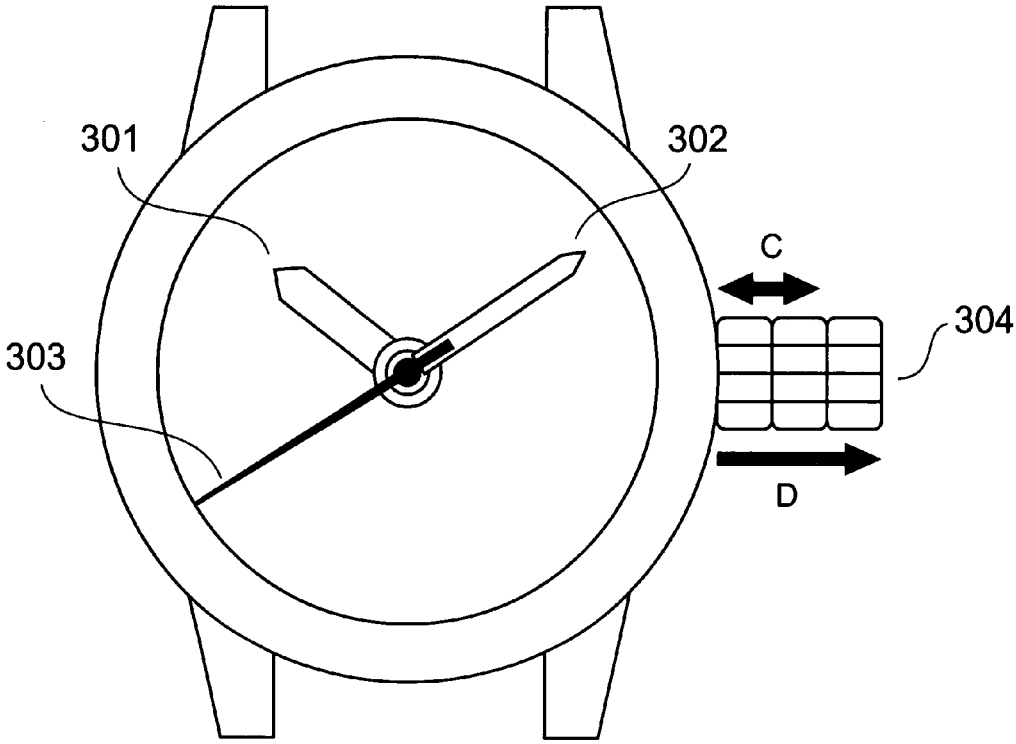
FIG. 5 is an external appearance view for explaining an operation of the second embodiment of the present invention.

Further, FIG. 5 is an external appearance view for explaining an operation of the second embodiment of the present invention, and the same reference numeral is applied to the same portion as FIG. 3.

Hereunder, by using FIG. 1, FIG. 4 and FIG. 5, there is explained the operation of the second embodiment of the present invention. Incidentally, the operation is explained mainly about portions different from the above first embodiment.

In explaining about the switching operation as to whether or not the standard radio signal is received, first the input circuit 110 outputs the operation signal complying with the state of the crown 304. On the basis of the operation signal from the input circuit 110, the control circuit 103 judges, after the crown 304 was operated to the one-stage-pulled position (the state "1") from the accommodation position (the state "0") as shown by an arrow C in FIG. 5, whether or not there was performed again the return operation (the reception ON mode operation) to the accommodation position (the state "0") (a step S401).

In the case where there was judged in the processing step S401 that the reception ON mode operation was performed on the basis of the operation signal, the control circuit 103 sets to the reception ON mode in which the periodic automatic reception is made ON (a step S402) and, by supplying the electric source to the reception circuit 109, forcibly performs the reception of the standard radio signal by making ON the reception operation of the reception circuit 109, thereby performing the time instant correction (a step S403).

On the other hand, in the case where it was judged in the processing step S401 that the reception ON mode operation was not performed, the control circuit 103 judges whether or not there was performed a two-stage pull operation (the reception OFF mode operation) in which the crown 304 remains in its two-stage-pulled position (a state "2") from the accommodation position (the state "0") as shown by an arrow D in FIG. 5 (a step S404). That is, the control circuit 103 judges whether or not the crown 304 was movement-operated so as to be placed in the two-stage-pulled position in which the time instant correction is possible by the manual operation.

In the case where it was judged in the processing step S404 that the reception OFF mode operation was performed on the basis of the operation signal, the control circuit 103 sets to the reception OFF mode making OFF the following automatic reception operation (a step S405). In a reception OFF mode operation position, by rotation-operating the crown 304, there is performed a time instant correction operation by the manual. Incidentally, the one-stage-pull-operated position is a correction position of a calendar (a day of the week, and a date) for instance.

In the case where it was judged in the processing step S404 that the reception OFF mode operation was not performed on the basis of the operation signal, the control circuit 103 finishes the processing.

Like the above, according to the present second embodiment, similarly to the above first embodiment, since it becomes possible to make OFF the reception operation under the state ordinarily using the timepiece without being conscious of making OFF the reception operation, there are brought about such advantages that the setting as to whether or not the time code is automatically received is simple, and it becomes possible to suppress the wasteful use of the electric power by the reception operation under the environment incapable of suitably receiving the time code.

Figure 6:
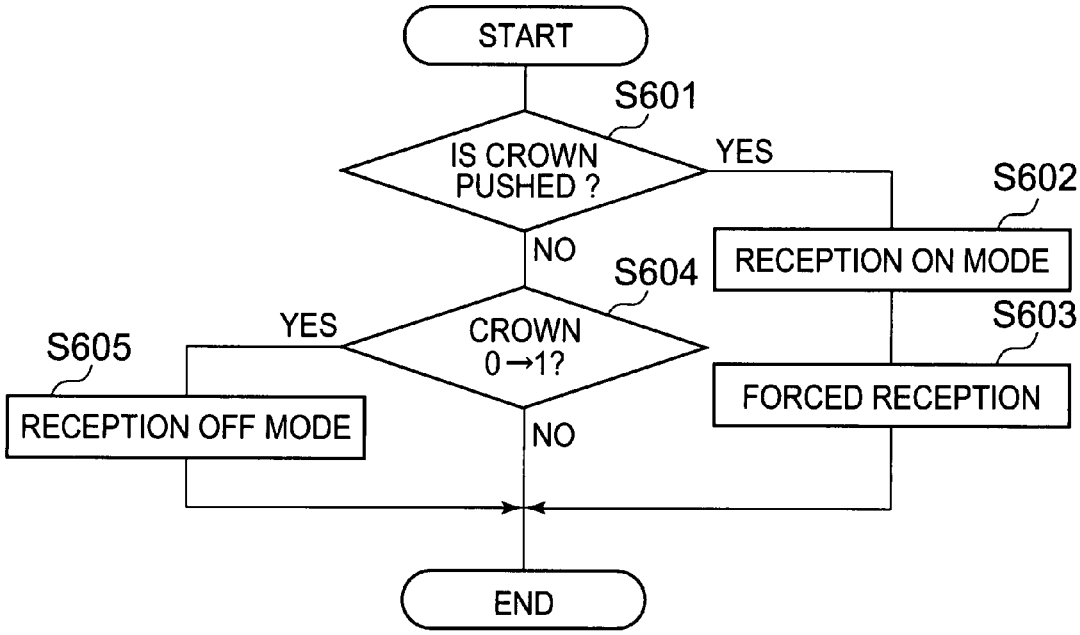
FIG. 6 is a flowchart showing processing of a third embodiment of the present invention.

FIG. 6 is a flowchart showing processing of the third embodiment of the present invention, and shows mainly the processing of the control circuit 103.

Figure 7:
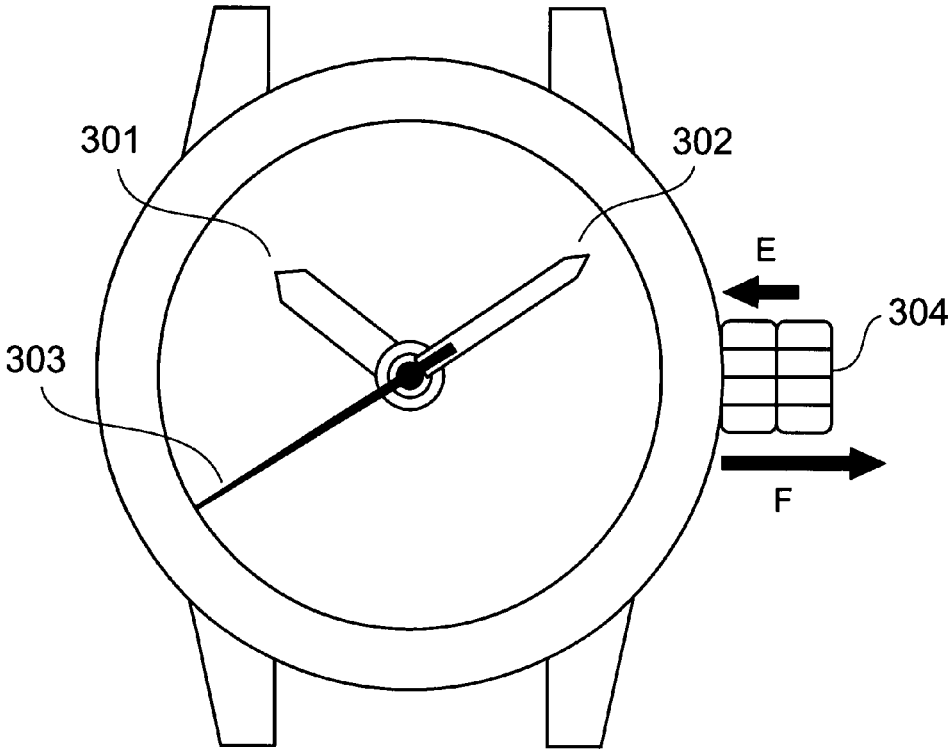
FIG. 7 is an external appearance view for explaining an operation of the third implementation of the present invention.

Further, FIG. 7 is an external appearance view for explaining an operation of the third embodiment of the present invention, and the same reference numeral is applied to the same portion as FIG. 3.

Hereunder, by using FIG. 1, FIG. 6 and FIG. 7, there is explained the operation of the third embodiment of the present invention. Incidentally, the operation is explained mainly about portions different from the above first and second embodiments.

In explaining about the switching operation as to whether or not the standard radio signal is received, first the input circuit 110 outputs the operation signal complying with the state of the crown 304. On the basis of the operation signal from the input circuit 110, the control circuit 103 judges whether or not the crown 304 was operated (the reception ON mode operation) to one-stage-pushed position from the accommodation position (the state "0") as shown by an arrow E in FIG. 7 (a step S601).

In the case where there was judged in the processing step S601 that the reception ON mode operation was performed on the basis of the operation signal, the control circuit 103 sets to the reception ON mode in which the periodic automatic reception is made ON (a step S602) and, by supplying the electric source to the reception circuit 109, forcibly performs the reception of the standard radio signal by making ON the reception operation of the reception circuit 109, thereby performing the time instant correction (a step S603).

In the case where it was judged in the processing step S601 that the reception ON mode operation was not performed, the control circuit 103 judges whether or not there was performed the one stage pull operation (the reception OFF mode operation) in which the crown 304 remains in its one-stage-pulled position (the state "1") from the accommodation position (the state "0") as shown by an arrow F in FIG. 7 (a step S604). That is, the control circuit 103 judges whether or not the crown 304 was operated so as to be placed in the one-stage-pulled position in which the time instant correction is possible by the manual operation.

In the case where it was judged in the processing step S604 that the reception OFF mode operation was performed on the basis of the operation signal, the control circuit 103 sets to the reception OFF mode making OFF the following automatic reception operation (a step S605). In the reception OFF mode operation position, by rotation-operating the crown 304, there is performed the time instant correction operation by hand.

In the case where it was judged in the processing step S604 that the reception OFF mode operation was not performed on the basis of the operation signal, the control circuit 103 finishes the processing.

Like the above, according to the present third embodiment, similarly to the above first embodiment, since it becomes possible to make OFF the reception operation under the state ordinarily using the timepiece without being conscious of making OFF the reception operation, there are brought about such advantages that the setting as to whether or not the time code is automatically received is simple, and it becomes possible to suppress the wasteful use of the electric power by the reception operation under the environment incapable of suitably receiving the time code.

Figure 8:
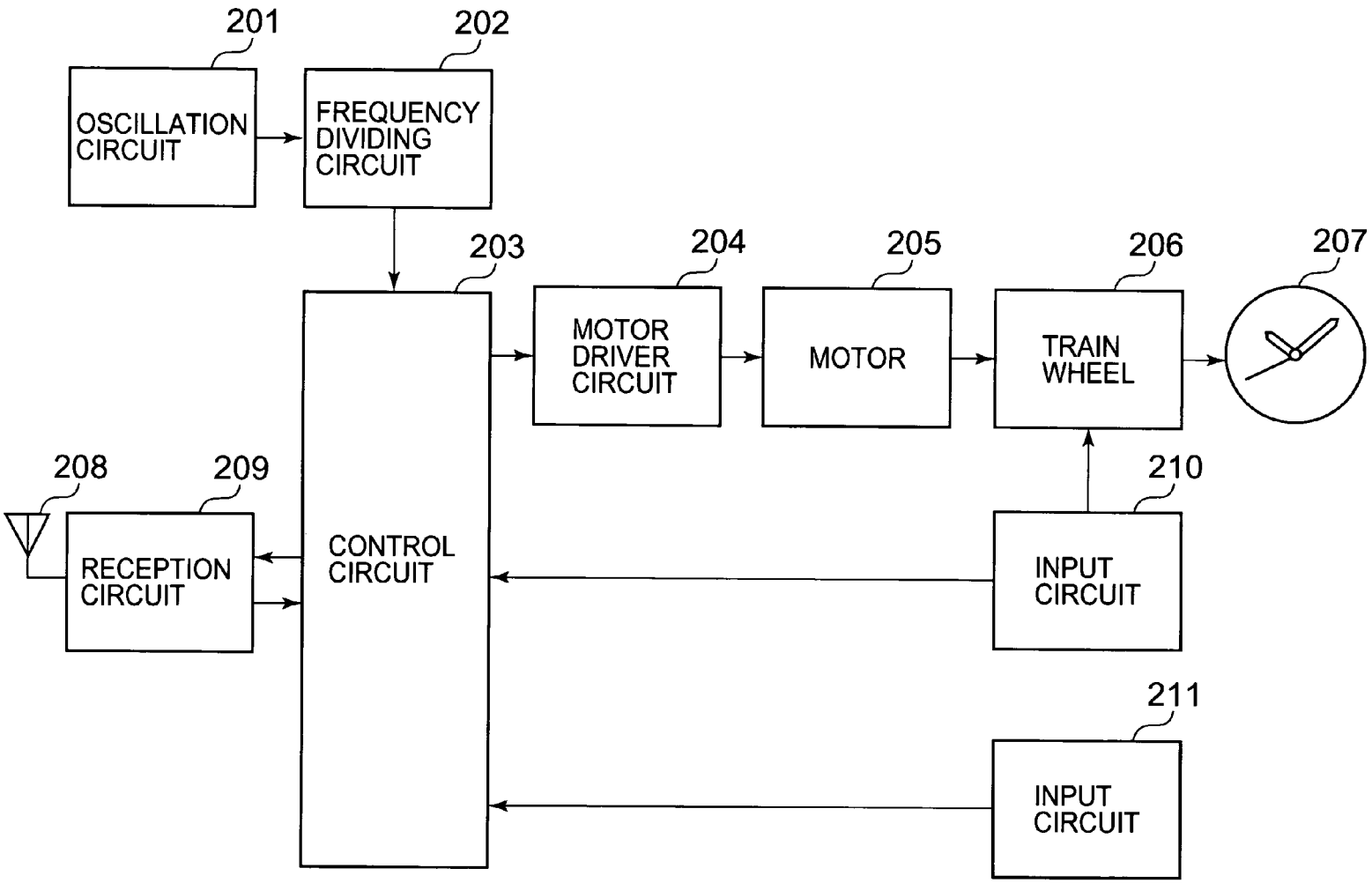
FIG. 8 is a block diagram of a radio-controlled timepiece concerned with a fourth embodiment of the present invention.

FIG. 8 is a block diagram of a radio-controlled timepiece concerned with a fourth embodiment of the present invention.

In FIG. 8, the radio-controlled timepiece possesses an oscillation circuit 201 outputting the signal of the predetermined frequency, a frequency dividing circuit 202 frequency-dividing the signal from the oscillation circuit 201 to thereby output the time signal becoming the reference of the clock operation, a control circuit 203 performing, by performing the clock operation based on the time signal, the output processing of the control signal for the time instant display, the control processing of each constituent element of the radio-controlled timepiece, or the after-mentioned processing and the like, a motor driver circuit 204 responding to the control signal from the control circuit 103 to thereby output the motor drive signal, the motor 205 rotation-driven by the motor drive signal, a train wheel 206 transmitting a rotation of the motor 205, a display part 207 having time instant hands (the hour hand, the minute hand, and the like) rotation-driven by the train wheel 206, an antenna 208, receiving the standard radio signal including the time code by the radio, a reception circuit 209 outputting the time code included in the standard radio signal received by the antenna 208, an input circuit 210 inputting the operation signal complying with the operation of the crown (not shown in the drawing), and an input circuit 211 inputting the operation signal complying with an operation of an operation button (not shown in the drawing).

Here, the control circuit 203 is clocking the present time instant by counting the time signal, and constitutes the clock means. Further, the control circuit 203 constitutes the time instant correction means correcting the present time instant which is being clocked to the time instant corresponding to the received time code, and the control means responding to the predetermined operation signal from the input circuit 210 to thereby make OFF the reception operation of the reception circuit 209. The antenna 208 and the reception circuit 109 constitutes the reception means receiving the time code by the radio. The display part 207 constitutes the display means, and the input circuit 210 constitutes, together with the crown mentioned later, the operation means. Further, the input circuit 211 constitutes, together with an after-mentioned operation button, the reception operation ON operation means.

Figure 9:
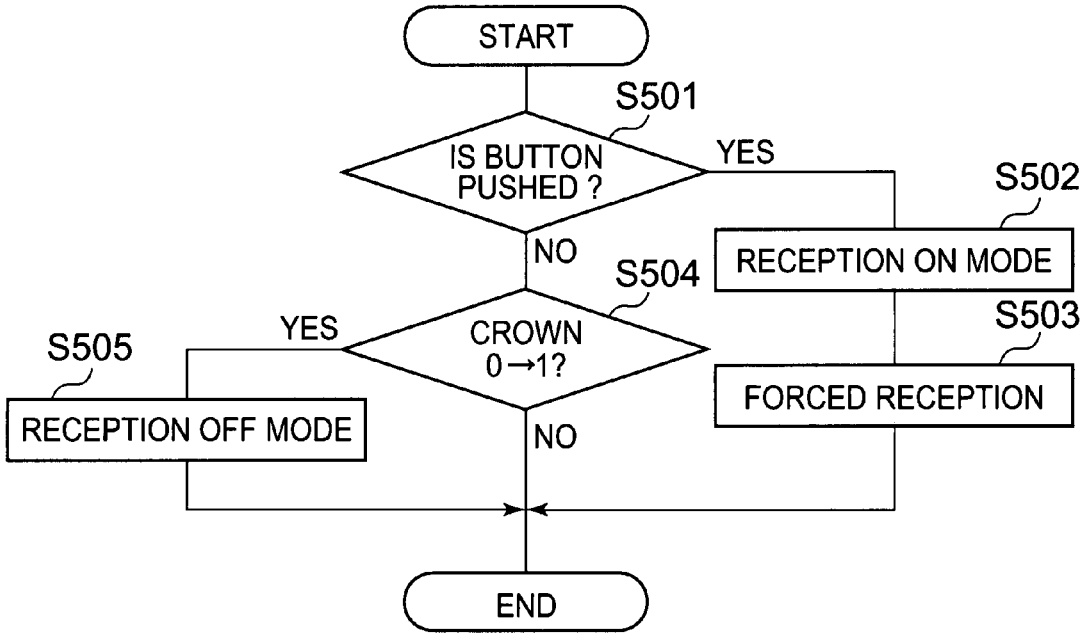
FIG. 9 is a flowchart showing processing of the fourth embodiment of the present invention.

FIG. 9 is a flowchart showing processing of the fourth embodiment of the present invention, and shows mainly the processing of the control circuit 203.

Figure 10:
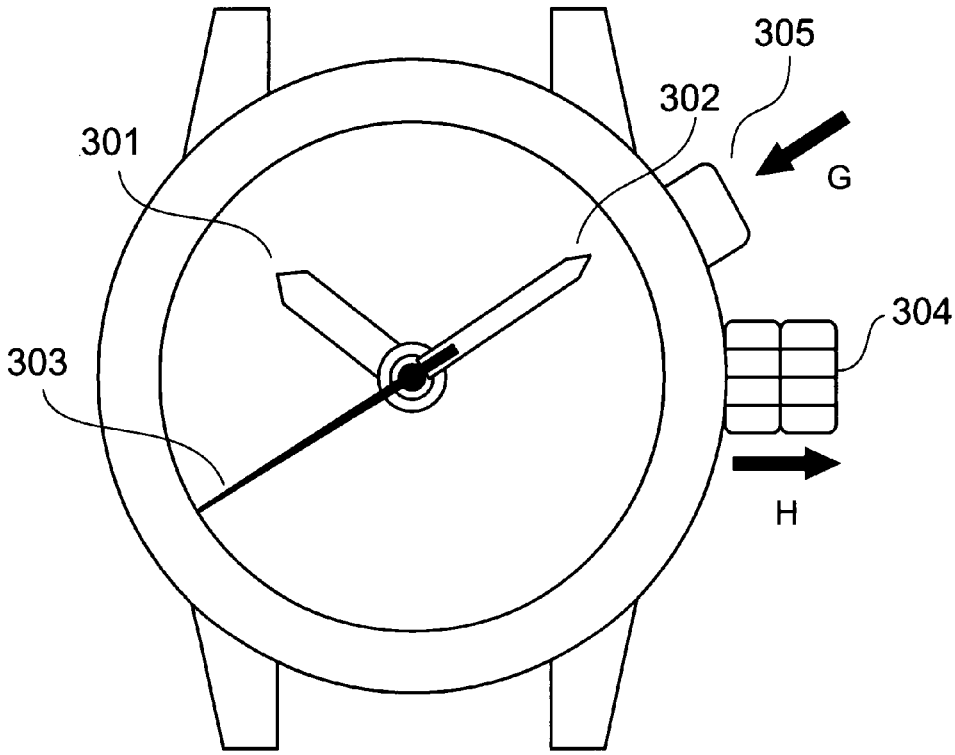
FIG. 10 is an external appearance view for explaining an operation of the fourth embodiment of the present invention.

Further, FIG. 10 is an external appearance view for explaining an operation of the fourth embodiment of the present invention. The radio-controlled timepiece possesses the time instant hands comprising the hour hand 301, the minute hand 302 and the second hand 303, the crown 304, and an operation button 305. The crown 304 is constituted so as to be capable of being pull-operated by one stage in an arrow H direction.

The input circuit 210 in FIG. 8 detects the state of the crown 304, and outputs the operation signal complying with that state. The crown 304 constitutes, together with the input circuit 210, the operation means.

Further, the operation button 305 is constituted so as to be capable of operating in an arrow G direction. The input circuit 211 in FIG. 8 detects a state of the operation button 305, and outputs an operation signal complying with that state. The operation button 305 constitutes, together with the input circuit 211, a reception operation ON operation means.

Hereunder, by using FIG. 8-FIG. 10, there is explained the operation of the fourth embodiment of the present invention.

In the ordinary mode in which there is performed the clock operation based on the timepiece signal from the frequency dividing circuit, 202, the radio-controlled timepiece performs the clock operation by the fact that the control circuit 203 counts the timepiece signal from the frequency dividing circuit 202, thereby outputting the control signal corresponding to the clock operation to the motor driver circuit 204. The motor driver circuit 204 rotation-drives the motor 205 by the dive signal corresponding to the control signal. The motor 205 rotation-drives the time instant hands of the display part 207 through the train wheel 206, thereby performing the analog display of the present time instant in the display part 207.

In the time instant correction mode in which the time instant correction is performed, by receiving the time code included in the standard radio signal, the control circuit 203 causes the reception circuit 209 to perform the reception operation of the standard radio signal by making ON the electric source of the reception circuit 209. The reception circuit 209 outputs the time code included in the standard radio signal received by the antenna 208 to the control circuit 203.

The control circuit 203 corrects own clocked time instant to the accurate present time instant corresponding to the time code, and outputs the control signal corresponding to the accurate present time instant to the motor driver circuit 204. The motor driver circuit 204 rotation-drives the motor 205 by the drive signal corresponding to the control signal, and the motor 205 rotation-drives the time instant hands of the display part 207 through the train wheel 206, thereby performing the analog display of the accurate present time instant corresponding to the time code in the display part 207.

Next, there is explained about the switching operation as to whether or not the standard radio signal is received.

The input circuits 210, 211 output an operation signal complying with states of the crown 304 and the operation button 305.

On the basis of the operation signal from the input circuit 211, the control circuit 203 judges whether or not the operation button 305 was operated (the reception ON mode operation) as shown by the arrow G in FIG. 10 (a step S501).

In the case where there was judged in the processing step S501 that the reception ON mode operation was performed on the basis of the operation signal, the control circuit 203 sets to a reception ON mode in which an periodic automatic reception is made ON (a step S502) and, by supplying the electric source to the reception circuit 209, forcibly performs the reception of the standard radio signal by making ON the reception operation of the reception circuit 209, thereby performing the time instant correction (a step S503).

In a case where it was judged in the processing step S501 that an operation of the operation button 305 was not performed, the control circuit 203 judges whether or not there was performed one stage pull operation (the reception OFF mode operation) in which the crown 304 remains in its one-stage-pulled position (the state "1") from the accommodation position (the state "0") as shown by the arrow H in FIG. 10 (a step S504). That is, the control circuit 203 judges whether or not the crown 304 was operated so as to be placed in the one-stage-pulled position in which the time instant correction is possible by the manual operation.

In the case where it was judged in the processing step S504 that the reception OFF mode operation was performed on the basis of the operation signal, the control circuit 203 sets to the reception OFF mode making OFF the following automatic reception operation (a step S505). In a reception OFF mode operation position, a time instant correction operation by hand is performed by rotation-operating the crown 304.

In the case where it was judged in the processing step S504 that the reception OFF mode operation was not performed on the basis of the operation signal, the control circuit 203 finishes the processing.

Like the above, according to the present fourth embodiment, there is made such that, when the operation button 305 was operated, there is performed the time instant correction by the reception of the standard radio signal and, when the crown 304 was placed in the time instant correction position by hand, the automatic reception operation is made OFF.

Accordingly, since it becomes possible to make OFF the reception operation under the state ordinarily using the timepiece without being conscious of making OFF the reception operation, the setting as to whether or not the time code is automatically received is simple, and it becomes possible to suppress the wasteful use of the electric power by the reception operation under the environment incapable of suitably receiving the time code.

Further, since there is constituted such that, by an operation of the operation button 305, the user forcibly performs the time instant correction by the reception of an standard radio signal, it becomes possible to easily perform the ON/OFF switching of the reception operation in compliance with whether or not there exists under the environment capable of receiving the time code.

Figure 11:
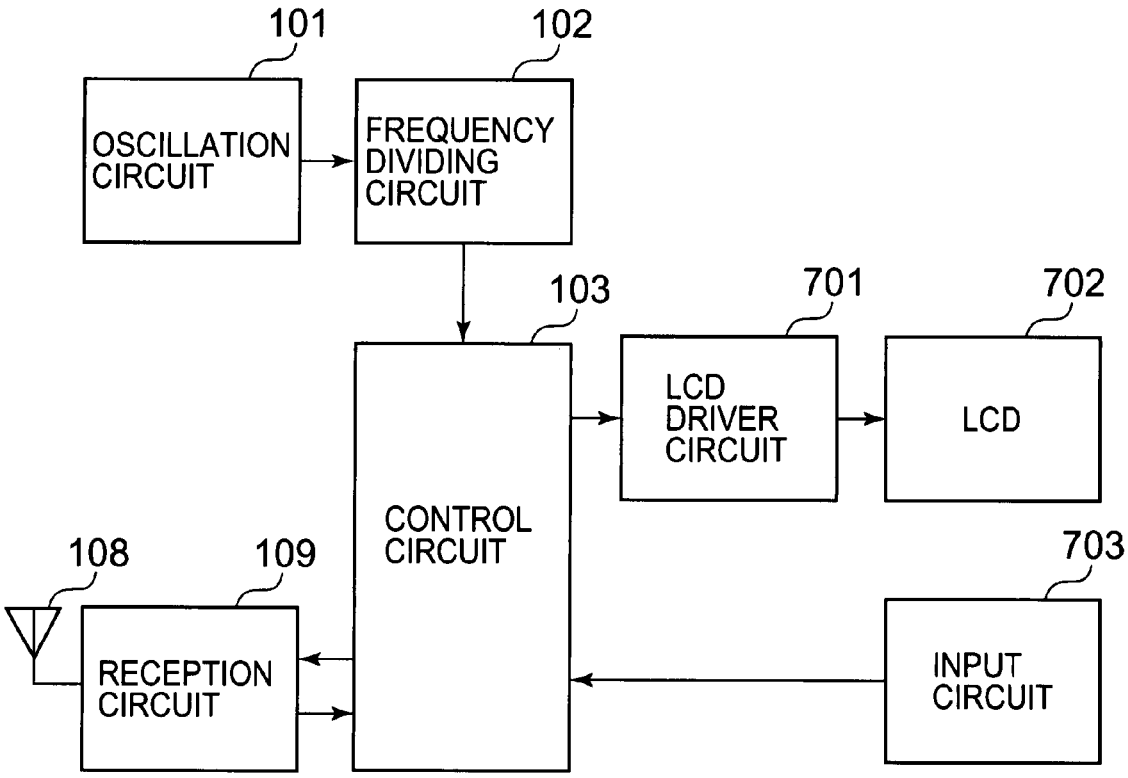
FIG. 11 is a block diagram of a radio-controlled timepiece concerned with a fifth embodiment of the present invention.

FIG. 11 is a block diagram of a radio-controlled timepiece concerned with a fifth embodiment of the present invention, and the same reference numeral is applied to the same portion as FIG. 1. Although the above embodiments 1-4 are examples of an analog display type radio-controlled timepiece, the present fifth embodiment is an example of a digital display type radio-controlled timepiece.

In FIG. 11, the radio-controlled timepiece possesses the oscillation circuit 101 outputting the signal of the predetermined frequency, the frequency dividing circuit 102 frequency-dividing the signal from the oscillation circuit 101 to thereby output the time signal becoming the reference of the clock operation, the control circuit 103 performing, by performing the clock operation based on the time signal, the output processing of the control signal for the time instant display, the control processing of each constituent element of the radio-controlled timepiece, or the after-mentioned processing and the like, an LCD driver circuit 701 responding to the control signal from the control circuit 103 to thereby drive a display part 702, the liquid crystal display part (LCD) 702 driven by the LCD driver circuit 701 and displaying the present time instant and the like, and an input circuit 703 inputting the operation signal complying with the operation of the operation button (not shown in the drawing).

Here, the control circuit 103 is clocking the present time instant by counting the time signal, and constitutes the clock means. Further, the control circuit 103 constitutes the time instant correction means correcting the present time instant which is being clocked to the time instant corresponding to the received time code, and the control means responding to the predetermined operation signal from the input circuit 703 to thereby make OFF the reception operation of the reception circuit 109. The antenna 108 and the reception circuit 109 constitute the reception means receiving the time code by the radio. Further, the display part 702 constitutes a display means, and the input circuit 703 constitutes, together with the operation button, an operation means.

When there was judged on the basis of the operation signal from the input circuit 703 that the operation button was in a time instant correction state by hand by being predetermination-operated, the control circuit 103 sets to the reception OFF mode in which the following automatic reception operation is made OFF.

Further, when there was judged that there was in the time instant correction state by the reception of the standard radio signal by forcibly controlling the reception operation of the reception circuit 109 to ON with the operation button being predetermination-operated, it sets to the reception ON mode in which the periodic automatic reception operation is made ON.

Like the above, according to the present fifth embodiment, since it becomes possible to make OFF the reception operation under the state ordinarily using the timepiece without being conscious of making OFF the reception operation, there are brought about such advantages that the setting as to whether or not the time code is automatically received is simple, and it becomes possible to suppress the wasteful use of the electric power by the reception operation under the environment incapable of suitably receiving the time code. Further, in compliance with whether or not there exists under the environment capable of receiving the time code, it becomes possible that the user easily performs the ON/OFF switching of the reception operation.

There can be applied also to the radio-controlled timepiece utilized in countries, such as not only Japan but also the USA, in which there is used the standard radio signal for the time instant correction.

What is claimed is:

1. A radio-controlled timepiece comprising:

reception means for receiving and outputting via radio communication a time code denoting a present time instant, the reception means having an ON mode and an OFF mode for disabling an operation thereof;

clock means for clocking a time instant;

display means for displaying a time instant clocked by the clock means;

time instant correction means for correcting the time instant clocked by the clock means to a time instant corresponding to the time code received by the reception means;

manual operation means for making a time instant correction operation possible in a predetermined time instant correction position; and control means for controlling a reception operation of the reception means to the OFF mode when the manual operation means is placed in the time instant correction position.

2. A radio-controlled timepiece according to claim 1, wherein the control means controls the reception operation of the reception means to the ON mode when the manual operation means is operated and placed in a position other than the time instant correction position.

3. A radio-controlled timepiece according to claim 1, further comprising a reception operation means for placing the reception operation of the reception means in the ON mode, wherein the control means controls the reception operation of the reception means to the ON mode when the reception operation means is operated.

4. A radio-controlled timepiece according to claim 1, wherein the operation means has comprises a crown, and the control means controls the reception operation of the reception means to the OFF mode when the crown is placed in the time instant correction position.

5. A radio-controlled timepiece according to claim 2, wherein the operation means comprises a crown, and the control means controls the reception operation of the reception means to the OFF mode when the crown is placed in the time instant correction position.

6. A radio-controlled timepiece according to claim 3, wherein the operation means has comprises a crown, and the control means controls the reception operation of the reception means to the OFF mode when the crown is placed in the time instant correction position.

7. A radio-controlled timepiece according to claim 4, wherein the control means controls the reception operation of the reception means to the ON mode when the crown is operated and placed in the position other than the time instant correction position.

8. A radio-controlled timepiece according to claim 5, wherein the control means controls the reception operation of the reception means to the ON mode when the crown is operated and placed in the position other than the time instant correction position.

9. A radio-controlled timepiece according to claim 6, wherein the control means controls the reception operation of the reception means to the ON mode when the crown is operated and placed in the position other than the time instant correction position.

* * * * *